US012747881B2

(12) United States Patent
Atluri et al.

(10) Patent No.: US 12,747,881 B2
(45) Date of Patent: Sep. 29, 2026

(54) SYSTEM AND METHOD FOR DETECTING LOW INDOOR AIR QUALITY AND ENABLING VENTILATION IN MULTI-ZONE

(71) Applicant: Carrier Corporation, Palm Beach Gardens, FL (US)

(72) Inventors: Sriram Atluri, Hyderabad (IN); Ramesh Babu Muniandy, Hyderabad (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 210 days.

(21) Appl. No.: 18/732,944

(22) Filed: Jun. 4, 2024

(65) Prior Publication Data

US 2024/0418381 A1 Dec. 19, 2024

Related U.S. Application Data

(60) Provisional application No. 63/508,485, filed on Jun. 15, 2023.

(51) Int. Cl.
*F24F 11/32* (2018.01)
*F24F 11/77* (2018.01)
(Continued)

(52) U.S. Cl.
CPC ..... *F24F 11/32* (2018.01); *F24F 11/77* (2018.01); *F24F 2110/10* (2018.01); *F24F 2110/50* (2018.01)

(58) Field of Classification Search
None
See application file for complete search history.

(56) References Cited

U.S. PATENT DOCUMENTS 5,394,934 A 3/1995 Rein et al.
5,520,328 A * 5/1996 Bujak, Jr. ..... F24F 11/54 454/239

(Continued)

FOREIGN PATENT DOCUMENTS

CN 110726431 A 1/2020
CN 115471128 A 12/2022

(Continued)

OTHER PUBLICATIONS

Extended European Search Report received for EP Application No. 24182367.3, mailed on Nov. 20, 2024, 7 Pages.

*Primary Examiner* — Ryan A Jarrett
(74) *Attorney, Agent, or Firm* — Souad Hakim

(57) ABSTRACT

A system for detecting low IAQ and enabling ventilation in a multi-zone environment is disclosed. The system comprises dampers configured in supply air channels associated with zones of the environment, and an IAQ sensor configured in a common return duct associated with the environment. When the IAQ values of combined return air are detected to vary, a controller successively operates one of the dampers in an open state while operating remaining zone dampers in a closed state, so that supply air flows into the zone having zone damper in the open state. The controller further successively monitors IAQ values of the return air received from each of the zones and accordingly detects a low IAQ condition in the zones when a difference is detected between the IAQ values of the return air from the respective zone, and the IAQ values of the combined return air received collectively from the zones.

20 Claims, 4 Drawing Sheets

(51) Int. Cl.
*F24F 110/10* (2018.01)
*F24F 110/50* (2018.01)

(56) References Cited

U.S. PATENT DOCUMENTS

| | | | |
|---|---|---|---|
| 6,711,470 | B1 | 3/2004 | Hartenstein et al. |
| 8,596,078 | B2 | 12/2013 | Williams et al. |
| 9,347,678 | B2 | 5/2016 | Stakutis et al. |
| 10,274,217 | B2 | 4/2019 | Gevelber |
| 11,384,950 | B2 | 7/2022 | Nourbakhsh et al. |
| 11,421,901 | B2 | 8/2022 | Morgan et al. |
| 2006/0234621 | A1 | 10/2006 | Desrochers et al. |
| 2008/0076346 | A1 | 3/2008 | Ahmed |
| 2016/0116181 | A1 | 4/2016 | Aultman et al. |
| 2023/0014295 | A1 | 1/2023 | Davis et al. |
| 2023/0088808 | A1 | 3/2023 | Patel et al. |
| 2024/0361031 | A1* | 10/2024 | Annavaram ..... F24F 11/0001 |

FOREIGN PATENT DOCUMENTS

| | | | |
|---|---|---|---|
| EP | 4119856 | A1 | 1/2023 |
| WO | 2020192210 | A1 | 10/2020 |
| WO | 2022250968 | A1 | 12/2022 |

* cited by examiner

SYSTEM AND METHOD FOR DETECTING LOW INDOOR AIR QUALITY AND ENABLING VENTILATION IN MULTI-ZONE

CROSS-REFERENCE TO RELATED APPLICATION

This patent application claims the benefit of U.S. Provisional Patent Application No. 63/508,485, filed on Jun. 15, 2023, which is incorporated by reference herein in its entirety.

BACKGROUND

This invention relates to the field of indoor air quality management systems, and more particularly, a system and method for detecting low indoor air quality (IAQ) and enabling ventilation in zones of a multi-zone environment.

In a multi-zone environment, a duct-based HVAC system may be used for circulating conditioned air between the HVAC system and different zones. Existing IAQ control solutions may involve indoor air quality (IAQ) sensors that may be placed in each of the zones to monitor the IAQ values of the zone. Further, based on the IAQ values of the zones, the air ventilation rate from the zones may be controlled.

SUMMARY

Described herein is a system for detecting low indoor air quality (IAQ) and enabling ventilation in zones of a multi-zone environment. The system comprises one or more zone dampers configured in one or more supply air channels associated with one or more zones of an area of interest (AOI), such that one of the zone dampers is configured in each of the supply channels for individually regulating the flow of supply air into each of the zones. Further, the system comprises an IAQ sensor configured in a common return duct associated with the AOI, wherein the IAQ sensor is operable to monitor IAQ values of a combined return air received collectively from the one or more zones and a controller in communication with the one or more zone dampers and the IAQ sensor. When the IAQ values of the combined return air are detected to vary and/or go below predetermined values, the controller is configured to successively operate one of the zone dampers in an open state while operating the remaining zone dampers among the one or more zone dampers in a closed state, such that the supply air flows into the zone having the respective zone damper in the open state and the corresponding return air from the respective zone flows into the common air duct, successively monitor, using the IAQ sensor, the IAQ values of the return air received from each of the zones when the respective zone damper is in the open state, and detect a low IAQ condition in the respective zones being monitored when a difference is detected between the IAQ values of the return air from the respective zone, and the IAQ values of the combined return air received collectively from the one or more zones.

In one or more embodiments, the system comprises one or more return air channels fluidically configured between the one or more zones and the common air duct, such that one of the return air channels is fluidically configured between one of the zones and the common air duct for individually supplying/regulating the return air from each of the zones into the combined air duct as the combined return air.

In one or more embodiments, the system comprises an air ventilator configured in at least one of the one or more zones, wherein the controller is configured to actuate the ventilator of the zone having the low IAQ condition to ventilate the low IAQ value air from the respective zone.

In one or more embodiments, the system comprises at least one blower fan configured with the one or more supply air channels, wherein the controller is configured to actuate the at least one blower fan to facilitate flow of the supply air from the one or more supply air channels to the common air duct via the one or more zones and the respective one or more return air channels.

In one or more embodiments, the system comprises an air handling unit (AHU) associated with the AOI, the AHU is fluidically connected to the one or more supply air channels and is in communication with the controller, wherein the controller is configured to actuate the AHU to facilitate flow of the supply air from the one or more supply air channels to the common air duct via the one or more zones and the respective one or more return air channels.

In one or more embodiments, the controller is configured to actuate the at least one blower fan or the AHU to enable the flow of ambient air into the zone having the low IAQ condition to facilitate ventilation of the low IAQ value air from the respective zone.

In one or more embodiments, the controller is configured to generate and transmit an alert signal to one or more mobile devices associated with one or more occupants of the one or more zones having the low IAQ condition.

In one or more embodiments, the system comprises a thermostat configured in each of the zones, wherein the controller is in communication with the thermostat and configured to generate and transmit an alert signal to the thermostat associated with the zone having the low IAQ condition.

In one or more embodiments, the alert signal is indicative of the detection of low IAQ values at the respective zone and a request to the corresponding occupant to manually ventilate the respective zone by opening doors and windows of the zone.

In one or more embodiments, when the IAQ values of the combined return air are detected to be constant or above the predetermined values, the controller is configured to operate the one or more zone dampers in any of the open state, a semi-closed state, the closed state based on predefined IAQ values set by the one or more occupants using the thermostat.

In one or more embodiments, the AOI is a building and the one or more zones are the one or more rooms of the building.

Also described herein is a method for detecting low indoor air quality (IAQ) and enabling ventilation in zones of a multi-zone environment. The method comprises the steps of: monitoring, by an IAQ sensor configured in a common return duct associated with an AOI, a combined return air received collectively from one or more zones associated with the AOI, wherein one or more zone dampers are configured in one or more supply channels associated with each of the zones for individually regulating the flow of supply air into each of the zones and the common air duct is fluidically connected to each of the zones via one or more return air channels; successively operating, by a controller, when the IAQ values of the combined return air are detected to vary and/or go below predetermined values, one of the zone dampers in an open state while operating the remaining zone dampers among the one or more zone dampers in a closed state, such that the supply air flows into the zone having the respective zone damper in the open state and the corresponding return air from the respective zone flows into the common air duct; successively monitoring, by the controller, using the IAQ sensor, the IAQ values of the return air received from each of the zones when the respective zone damper is in the open state; and detecting, by the controller, a low IAQ condition in the respective zones being monitored when a difference is detected between the IAQ values of the return air from the respective zone, and the IAQ values of the combined return air received collectively from the one or more zones.

In one or more embodiments, the method comprises the steps of actuating, by the controller, a ventilator associated with the zone having the low IAQ condition to ventilate the low IAQ value air from the respective zone.

In one or more embodiments, the method comprises the step of actuating, at least one blower fan configured with the one or more supply air channels, to facilitate flow of the supply air from the one or more supply air channels to the common air duct via the one or more zones and the respective one or more return air channels.

In one or more embodiments, the method comprises the step of actuating an air handling unit (AHU) associated with the AOI to facilitate flow of the supply air from the one or more supply air channels to the common air duct via the one or more zones and the respective one or more return air channels.

In one or more embodiments, the method comprises the step of actuating, by the controller, the at least one blower fan or the AHU to enable the flow of ambient air into the zone having the low IAQ condition to facilitate ventilation of the low IAQ value air from the respective zone.

In one or more embodiments, the method comprises the step of generating and transmitting, by the controller, an alert signal to one or more mobile devices associated with one or more occupants of the one or more zones having the low IAQ condition.

In one or more embodiments, the alert signal is indicative of the detection of low IAQ values at the respective zone and a request to the corresponding occupant to manually ventilate the respective zone by opening doors and windows of the zone.

In one or more embodiments, when the IAQ values of the combined return air are detected to be constant and/or above the predetermined values, the method comprises the steps of operating, by the controller, the one or more zone dampers in the open state, a semi-closed state, or the closed state, based on predefined IAQ values set by the one or more occupants using the thermostat.

The foregoing summary is illustrative only and is not intended to be in any way limiting. In addition to the illustrative aspects, embodiments, and features described above, further aspects, embodiments, features, and techniques of the subject disclosure will become more apparent from the following description taken in conjunction with the drawings.

BRIEF DESCRIPTION OF THE DRAWINGS

The accompanying drawings are included to provide a further understanding of the subject disclosure and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1:
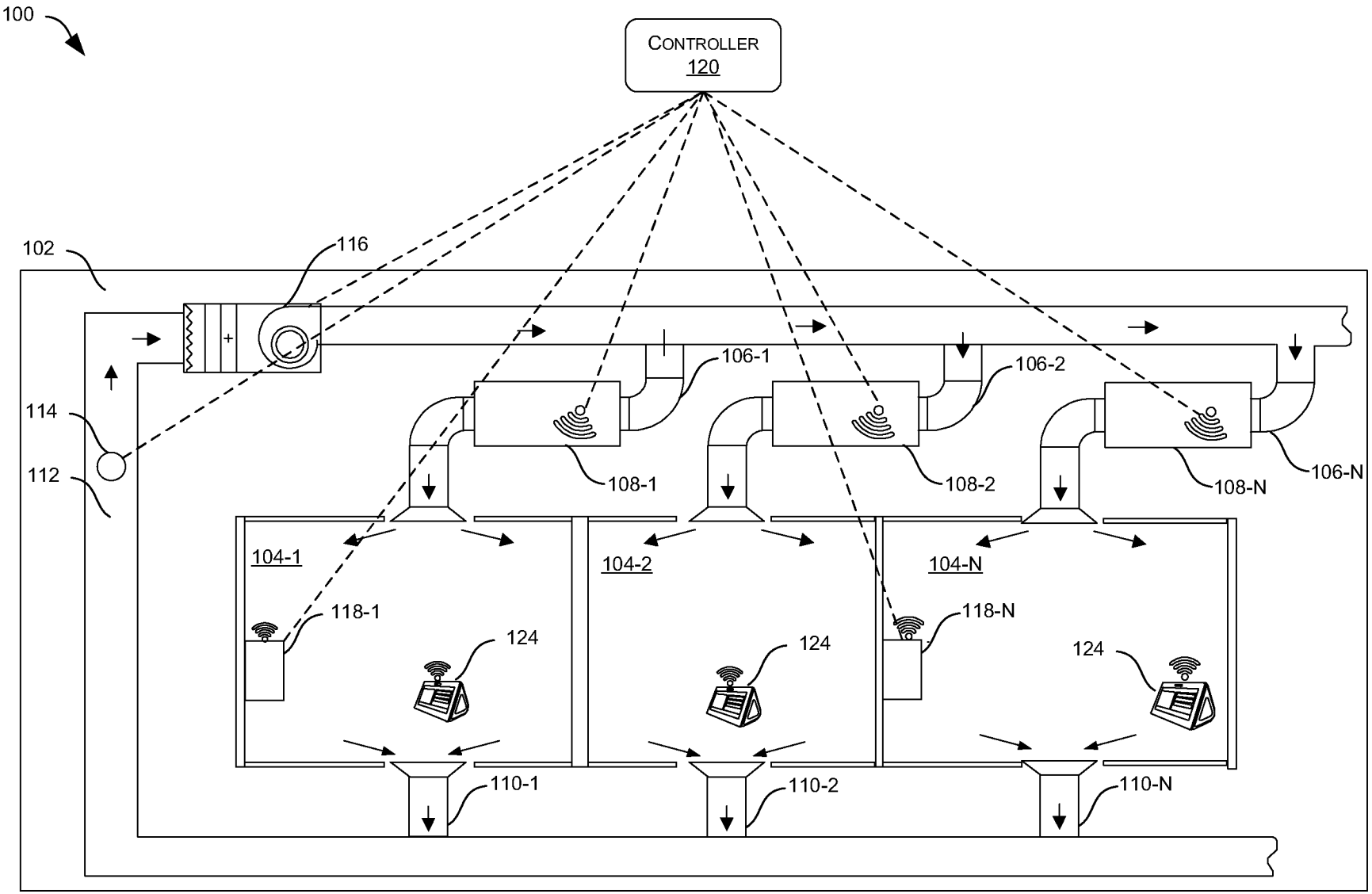
FIG. 1 illustrates an exemplary representation of a system for detecting low indoor air quality (IAQ) and enabling ventilation in zones of a multi-zone environment, in accordance with one or more embodiments of the subject disclosure.

The following is a detailed description of embodiments of the subject disclosure depicted in the accompanying drawings. The embodiments are in such detail as to clearly communicate the subject disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, described herein may be oriented in any desired direction.

In a multi-zone environment such as but not limited to a building having multiple floors and multiple rooms, a duct-based heating, ventilation, and air conditioning (HVAC) system may be installed for supplying a conditioned and fresh air to different zones. The HVAC system may include a supply air stream duct having a plurality of interconnected supply air channels through which the supply air flows to the zones, and a return air duct having a plurality of interconnected return air channels through which the return air from each zone recirculates. The HVAC system may further involve an air handling unit (AHU) or blower fans connected to the supply air stream duct and the return air stream duct to receive fresh outside air, condition the outside air, and supply the conditioned fresh air throughout the ducts across different zones in a timely manner.

The indoor air quality (IAQ) at the zones may be negatively affected because of increased levels of CO, CO2, VOCs, particulates, bacteria, and the like present in the zones or the environment. Existing IAQ control solutions may involve multiple IAQ sensors that may be placed in each of the zones to monitor the IAQ values of the zone. Accordingly, based on the IAQ values of the zones, the air ventilation rate from the zones may be controlled to maintain good IAQ at the zones. However, the use of multiple IAQ sensors in a multi-zone environment may be expensive and difficult to monitor and control. Moreover, the existing IAQ control solutions may effectively work by clearing the entire zones even if low IAQ condition only pertains to some specific zones, thereby making it inconvenient for the occupants of the zones.

This invention provides a simple, efficient, and cost-effective system and method that may be easily configured with the existing HVAC system and IAQ control system of any multi-zone environment, to detect low indoor air quality (IAQ) and enable ventilation in the zones of the multi-zone environment. In addition, the invention may be implemented in zones having no air ventilation system and may alert occupants in the event of low IAQ conditions.

Figure 2:
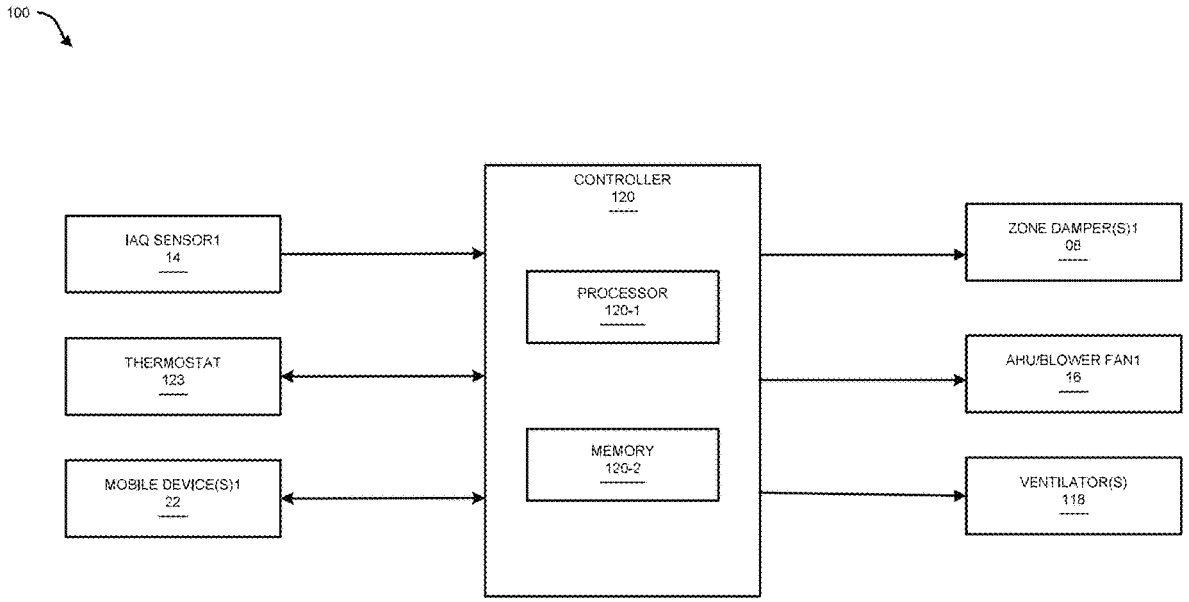
FIG. 2 illustrates an exemplary block diagram of the system of FIG. 1, in accordance with one or more embodiments of the subject disclosure.

Referring to FIGS. 1 and 2, a system 100 configured with an HVAC system of a multi-zone environment or an area of interest (AOI) 102 is disclosed, which detects low indoor air quality (IAQ) in the zones of the environment/AOI and further enables ventilation in the zones to maintain good IAQ. The multi-zone environment 102 (also referred to as an area of interest (AOI) 102, herein) may include a plurality of zones 104-1 to 104-N (collectively referred to as zones 104, herein). The system 100 may involve the existing components of the HVAC system of the AOI, without any additional elements.

The HVAC system of the environment/AOI may include a supply air stream duct comprising a plurality of interconnected supply air channels 106-1 to 106-N (collectively designated as supply air channels 106, herein) fluidically connected to the zones 104-1 to 104-N of the AOI 102. Further, one or more zone dampers 108-1 to 108-2 may be configured in the supply air channels 106-1 to 106-N such that one of the zone dampers 108-1 to 108-N may be configured in each of the supply air channels 106-1 to 106-N for individually regulating the flow of supply air into each of the zones 104-1 to 104-N. The HVAC system may further include a return air duct comprising a plurality of interconnected return air channels 110-1 to 110-N (collectively referred to as return air channels 110, herein) to facilitate the outflow of return air from each of the zones 104. The outlet of each of the return air channels 110-1 to 110-N may be connected to a common return air duct 112, such that the common return air duct 112 may collectively receive return air from each of the zones 104-1 to 104-N. The return air channels 110 may be fluidically configured between the zones 104-1 to 104-N and the common return air duct 112, such that one of the return air channels 110-1 to 110-N may be fluidically configured between one of the zones 104-1 to 104-N and the common return air duct 112 for individually supplying/regulating the return air from each of the zones 104-1 to 104-N into the common return air duct 112 as the combined return air.

The system 100 may include an indoor air quality (IAQ) sensor 114 (also referred to as a sensing device, herein) configured in the common return air duct 112 to monitor IAQ values of a combined return air received collectively from the one or more zones 104. In one or more embodiments, the IAQ sensor 114 may be a single sensing device such as a thermostat and the like comprising one or more of a volatile organic compound sensor, a carbon dioxide sensor, a particulate matter sensor, a carbon monoxide sensor, an ethylene sensor, a formaldehyde sensor, a radon sensor, a methane sensor, an ozone sensor, a sulfur dioxide sensor, a nitric oxide, and a nitrous oxide sensor. Further, in some embodiments, the different IAQ sensors (collectively designated as the IAQ sensor 114, herein) may be distributed in the common return air duct 112 to monitor IAQ values of the received combined return air. The IAQ sensor 114 may be operable to monitor the levels of one or more of volatile organic compounds, carbon dioxide, particulate matter, carbon monoxide, ethylene, formaldehyde, radon, methane, ozone, sulfur dioxide, nitric, nitrous oxide sensor, and the like present in the combined return air.

In one or more embodiments, the HVAC system of the AOI may further include an air handling unit (AHU) 116 fluidically connected to the supply air stream duct/supply air channels 106 and the common return air duct 112 to facilitate the flow of the supply air from the supply air channels 106 to the common air 112 duct via the one or more zones 104 and the respective return air channels 110. In other embodiments, the HVAC system of the environment may include at least one blower fan (also designated as 116, herein) fluidically connected to the supply air stream duct and the common return air duct 112 to facilitate the flow of the supply air from the supply air channels 106 to the common return air duct 112 via the one or more zones 104 and the respective return air channels 110.

The HVAC system may include a central damper (not shown) configured to regulate the flow of supply air comprising any or a mixture of outside air and the return air into the supply airstream duct/supply air channel 106. Further, the system 100 may include the plurality of zone dampers 108 which may be installed in the interconnected supply air channels 106 such that one of the zone dampers 108 may be configured in each of the supply air channels 106 for individually regulating the flow of supply air into each of the zones. For instance, as shown, the zone damper 108-1 may be configured in the supply air channel 106-1. Further, the zone damper 108-2 may be configured in the supply air channel 106-N. Similarly, the N-number of zone dampers 108-N may be configured in the N-number of supply air channels 106-N. The zone damper 108 may be configured to be operated in a closed state, a semi-closed state, or an open state. In the closed state, the zone damper 108 may completely restrict the flow of air through the respective supply air channel 106 and into the respective zone 104. Further, in the open state, the zone damper 108 may allow an unrestricted flow of air through the respective supply air channel 106 and into the respective zone 104. Furthermore, in the semi-closed state or semi-open state, the zone damper 108 may allow a reduced flow of air through the respective supply air channel 106 and into the respective zone 104.

In one or more embodiments, the HVAC system may further include an air ventilator 118-1 to 118-N (collectively designated as ventilator 118, herein) configured in at least one of the zones 104-1 to 104-N. The ventilator 118 may be operable to ventilate the air from the respective zone 104. Further, when no ventilator is present in any of the zones 104, the ventilation in such zones 104 may be manually done by opening the doors and windows of the respective zones 104. It would be obvious for a person skilled in the art that while FIG. 1 illustrates the zones 104-1, and 104-N having ventilators 118-1 and 118-N and the zone 104-2 not having the ventilator, however, all the zones 104 may also include the ventilator 118 depending on the AOI or at least some of the zones 104 may include the ventilator 118 without any limitation.

The system may include a controller 120 communicatively connected to the AHU/blower fan 116, the zone dampers 108, the IAQ sensor 114, the air ventilators 118, and other components of the HVAC system to control the operation of the HVAC system. The controller 120 may include a processor 120-1 coupled to a memory 120-2 storing instructions executable by the processor 120-1 to enable the controller 120 to perform one or more designated operations.

The system 100 may further include one or more mobile devices 122 associated with occupants of the zones 104. The mobile devices 122 may be in communication with the controller and may allow the occupants to monitor the IAQ of the zones 104 and further set predefined IAQ values for the respective zones 104.

The controller 120 may be configured to monitor IAQ values of a combined return air received collectively from the zones 104 of the AOI 102. Until the IAQ values of the combined return air are detected to be constant and/or above the predetermined values by the IAQ sensor 114, the controller 120 may keep operating the zone dampers 108 in any of the open state, a semi-closed state, the closed state based on the predefined IAQ values set for the zones by the occupants using a thermostat 124 provided in the zones 104.

In one or more embodiments, when the IAQ values of the combined return air are detected to vary and/or go below predetermined values by the IAQ sensor 114, the controller 120 may successively operate one of the zone dampers in an open state while operating the remaining zone dampers among the one or more zone dampers 108-1 to 108-N in a closed state, such that the supply air flows into the zone 104 having the respective zone damper in the open state and the corresponding return air from the respective zone flows into the common return air duct 112. For instance, the controller 120 may operate the zone damper 108-1 in an open state while operating the remaining zone dampers 108-2 to 108-N in a closed state, such that the supply air may flow into the zone 104-1 and the corresponding return air from the zone 104-1 may flow into the common return air duct 112. Further, the controller 120 may operate the zone damper 108-2 in an open state while operating the remaining zone dampers 108-1, and 108-3 to 108-N in a closed state, such that the supply air may flow into the zone 104-2 and the corresponding return air from the zone 104-2 may flow into the common return air duct 112. Similarly, the controller may individually and successively operate all the zone dampers in the open state one at a time while keeping the other zone dampers in the closed state. This process of successively operating one of the zone dampers in the open state while keeping the remaining zone dampers in the closed state may enhance the airflow in that zone and a positive pressure created may increase the return air supply from the respective zone into the common return air duct.

Further, the controller 120 may successively monitor, using the IAQ sensor 114, the IAQ values of the return air received in the common return air duct 112 from each of the zones 104 when their respective zone damper 108 is in the open state. For instance, when only the zone damper 108-1 is in the open state, the controller 120 may monitor the IAQ values of the return air received in the common return air duct 112 from the zone 104-1 only. Further, when only the zone damper 108-2 is in the open state, the controller 120 may monitor the IAQ values of the return air received in the common return air duct 112 from the zone 104-2 only. Similarly, the controller 120 may monitor or scan the IAQ values of the return air received in the common return air duct from each of the zones one by one. As the (combined) return air received in the common return air duct 112 is mainly from the zone 104 having the zone damper 108 in the open state (as other zone dampers are in the closed state), the IAQ values of the return air detected in the common return air duct 112 may be indicative of the IAQ values of the respective zone 104.

Accordingly, the controller 120 may be configured to detect or identify a low IAQ condition in the respective zones 104 being individually monitored when a fluctuation or difference is detected between the IAQ values of the return air from the respective zone 104, and the IAQ values of the combined return air received collectively from the one or more zones 104-1 to 104-N. Further, when the IAQ values of return air from the respective zone 104 being individually monitored, and the IAQ values of the combined return air received collectively from the one or more zones 104-1 to 104-N are detected to be relatively stable, the controller 120 may identify the respective zone to have good IAQ. For instance, when a difference is detected between the IAQ values of return air from the zone 104-1, and the IAQ values of the combined return air received collectively from the one or more zones 104-1 to 104-N, the controller 120 may identify the zone 104-1 to have a low/bad IAQ value. Further, when the difference between the IAQ values of return air from the zone 104-2, and the IAQ values of the combined return air received collectively from the one or more zones 104-1 to 104-N is detected to be relatively stable, the controller 120 may identify the zone 104-2 to have good IAQ value.

In one or more embodiments, when the IAQ values sensed by the IAQ sensor 114 are varying or fluctuating, the sensor's output (Voltage/current) value may be increasing or decreasing based on the sensor type. In an example, but not limited to the like, a particulate matter (IAQ) sensor configured for measurement of particulate matter level in the range of 0-700 μg/m3 of air, may generate a proportionate current output value of 4-20 milli Amperes (mA), where detection of 0 μg/m3 particulate matters in the air may generate an output of 4 mA and 700 μg/m3 may generate an output of 20 mA. Accordingly, a difference between the detected particulate matter (IAQ) levels in the return air from one of the zones and the combined return air received collectively from all the zones 104-1 to 104-N may generate a proportionate change in the sensor's output (voltage/current) based on the difference, which may enable the controller 120 to identify the IAQ level of the respective zone.

In one or more embodiments, the controller 120 may be configured to actuate the ventilator 118 of the zone 104 having the low IAQ condition to ventilate the low IAQ value air from the respective zone 104. Further, in other embodiments, the controller 120 may be configured to actuate the blower fan or the AHU 116 to enable the flow of ambient air or clean supply air into the zone 104 having the low IAQ condition to facilitate ventilation of the low IAQ value air from the respective zone 1041. Furthermore, in other embodiments, the controller 120 may be configured to generate and transmit an alert signal to the mobile devices 122 associated with the occupants of the zones 104 having the low IAQ condition and/or to the thermostat 124 provided in the zones 104 having the low IAQ condition. The alert signal may be indicative of the detection of low IAQ values at the respective zone and a request to the corresponding occupant to manually ventilate the respective zone 104 by opening doors and windows of the zone 104.

The controller 120, the AHU/blower fan 116, the zone dampers 108, the IAQ sensor 114, the mobile devices 122, and the air ventilators 118 may include a transceiver or a communication module to communicatively connect the controller 120 to one or more of the AHU/blower fan 116, the zone dampers 108, the IAQ sensor 114, the mobile devices 122, and the air ventilators 118, through a network via wired and/or wireless media. In one or more embodiments, the controller 120 may be a control unit associated with the HVAC system of the AOI 102. However, in other embodiments, the controller 120 may be a central server that may be in communication with the control unit of the HVAC system. In one or more embodiments, the system 100 or controller 120, and the mobile devices 122 associated with the occupants may be operatively coupled to a website and so be operable from any Internet-enabled user device. Examples of mobile devices may include but are not limited to, a portable computer, a personal digital assistant, a hand-held device, and a workstation.

In one implementation, the network can be a wireless network, a wired network or a combination thereof. Network can be implemented as one of the different types of networks, such as intranet, local area network (LAN), wide area network (WAN), the internet, and the like. Further, the network may either be a dedicated network or a shared network. The shared network represents an association of the different types of networks that use a variety of protocols, for example, Hypertext Transfer Protocol (HTTP), Transmission Control Protocol/Internet Protocol (TCP/IP), Wireless Application Protocol (WAP), and the like, to communicate with one another. Further, network can include a variety of network devices, including transceivers, routers, bridges, servers, computing devices, storage devices, and the like. In another implementation the network can be a cellular network or mobile communication network based on various technologies, including but not limited to, Global System for Mobile (GSM), General Packet Radio Service (GPRS), Code Division Multiple Access (CDMA), Long Term Evolution (LTE), WiMAX, 5G or 6G network protocols, and the like.

Figure 3:
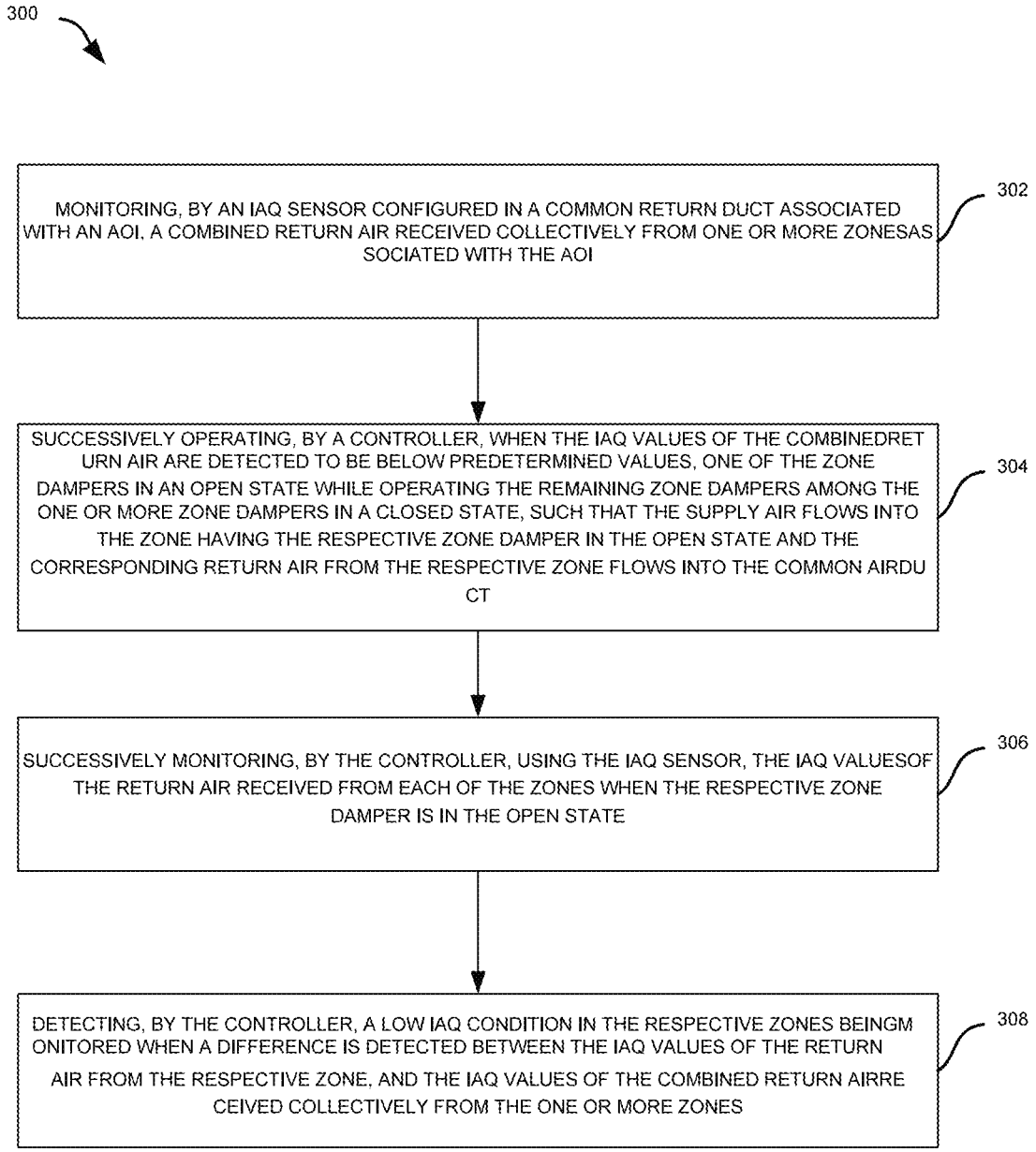
FIG. 3 illustrates an exemplary flow diagram of a method for detecting low indoor air quality (IAQ) and enabling ventilation in zones of a multi-zone environment, in accordance with one or more embodiments of the subject disclosure

Referring to FIG. 3, method 300 for detecting low indoor air quality (IAQ) and enabling ventilation in zones of a multi-zone environment is disclosed. Method 300 may involve the controller 120, the AHU/blower fan 116, the ventilator 118, the mobile devices 122, the IAQ sensor 114, and other components associated with the system 100 of FIGS. 1 and 2. Method 300 may include step 302 of monitoring, by the IAQ sensor configured in a common return duct associated with an AOI, a combined return air received collectively from one or more zones associated with the AOI.

Further, when the IAQ values of the combined return air are detected to vary and/or go below predetermined values, method 300 may include step 304 of successively operating, by the controller, one of the zone dampers in an open state while operating the remaining zone dampers in a closed state, such that the supply air flows into the zone having the respective zone damper in the open state and the corresponding return air from the respective zone flows into the common return air duct. Method 300 may further include step 306 of successively monitoring, by the controller, using the IAQ sensor, the IAQ values of the return air received from each of the zones when the respective zone damper is in the open state.

Accordingly, method 300 may further include step 308 of detecting or identifying a low IAQ condition in the respective zones being monitored at step 304 when a fluctuation or difference is detected between the IAQ values of the return air from the respective zone being monitored at step 306 and the IAQ values of the combined return air (received collectively from the zones) being monitored at step 302.

Further, when the IAQ values of the return air from the respective zone being monitored at step 306, and the IAQ values of the combined return air (received collectively from the zones) being monitored at step 302 are detected or monitored to be relatively stable, method 300 may include the step of detecting or identifying a good IAQ condition in the respective zones being monitored at step 304.

In one or more embodiments, method 300 may include the steps of actuating, by the controller, a ventilator associated with the zone having the low IAQ condition to ventilate the low IAQ value air from the respective zone. Further, in other embodiments method 300 may include the step of actuating, by the controller, the blower fan or the AHU to enable the flow of ambient air into the zone having the low IAQ condition to facilitate ventilation of the low IAQ value air from the respective zone.

Furthermore, in one or more embodiments, method 300 may include the step of generating and transmitting, by the controller, an alert signal to the mobile devices associated with the occupants of the zones having the low IAQ condition or to the thermostat provided in the zones having the low IAQ condition. The alert signal may be indicative of the detection of low IAQ values at the respective zone and a request to the corresponding occupant to manually ventilate the respective zone by opening doors and windows of the zone.

In one or more embodiments, method 300 may include the step of actuating, the blower fan configured with the supply air channels, to facilitate the flow of the supply air from the supply air channels to the common return air duct via the zones and the respective return air channels. Further, in other embodiments, method 300 may include the step of actuating the AHU associated with the AOI to facilitate the flow of the supply air from the supply air channels to the common return air duct via the zones and the respective return air channels.

In one or more embodiments, when the IAQ values of the combined return air are detected to be constant and/or above the predetermined values, method 300 may include the steps of operating the one or more zone dampers in the open state, a semi-closed state, or the closed state, based on predefined IAQ values set by the occupants for the respective zones using the thermostat or the mobile device.

Those skilled in the art would appreciate that the system and method are using the existing blower fan, AHU, zone dampers, and duct system which are already installed in the AOI without any additional hardware elements, which keeps the system simple, cost-effective, and sustainable. Moreover, the use of just one IAQ sensor/sensing device/thermostat in the common return air duct (compared to existing solutions where multiple IAQ sensors/sensing devices are provided at each zone), further makes the system cost-effective, sustainable, and easy to control. In addition, the IAQ detection process may be quickly done even when occupants are present in the zones (which may be difficult to achieve in existing solutions), thereby making it inconvenient for the occupants of the zones. Further, the system may alert the occupants and also enable ventilation in the low IAQ zones even when no air ventilator is present in the zones.

Thus, the invention provides a simple, efficient, and cost-effective system and method that may be easily configured with the existing HVAC system and IAQ control system of any multi-zone environment, to detect low indoor air quality (IAQ) and enable ventilation in the zones of the multi-zone environment. In addition, the invention may be implemented in zones having no air ventilation system and may alert occupants in the event of low IAQ detection.

Figure 4:
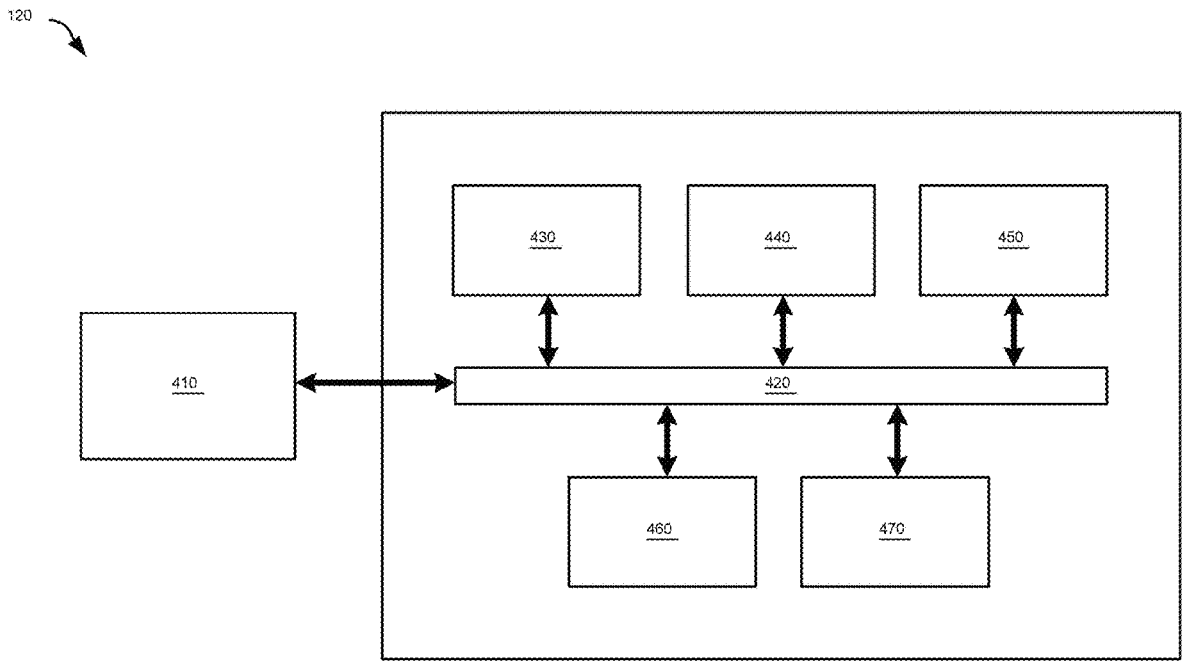
FIG. 4 illustrates an exemplary schematic block diagram of a hardware system used for implementing the controller of FIGS. 1 to 3, respectively, in accordance with one or more embodiments of the subject disclosure.

FIG. 4 is an exemplary schematic block diagram of a hardware system used for implementing the controller 120. As shown in FIG. 4, the controller 120 can include an external storage device 410, a bus 420, a main memory 430, a read only memory 440, a mass storage device 450, communication port 460, and a processor 470. A person skilled in the art will appreciate that the controller 120 may include more than one processor and communication ports. Examples of processor 470 include, but are not limited to, an Intel® Itanium® or Itanium 2 processor(s), or AMD® Opteron® or Athlon MP® processor(s), Motorola® lines of processors, FortiSOC™ system on chip processors or other future processors. Processor 470 may include various modules. Communication port 460 can be any of an RS-232 port for use with a modem-based dialup connection, a 10/100 Ethernet port, a Gigabit or 10 Gigabit port using copper or fibre, a serial port, a parallel port, or other existing or future ports. Communication port 460 may be chosen depending on a network, such a Local Area Network (LAN), Wide Area Network (WAN), or any network to which controller 120 connects. Memory 430 can be Random Access Memory (RAM), or any other dynamic storage device commonly known in the art. Read-only memory 440 can be any static storage device(s) e.g., but not limited to, a Programmable Read Only Memory (PROM) chips for storing static information e.g., start-up or BIOS instructions for processor 470. Mass storage 450 may be any current or future mass storage solution, which can be used to store information and/or instructions. Exemplary mass storage solutions include, but are not limited to, Parallel Advanced Technology Attachment (PATA) or Serial Advanced Technology Attachment (SATA) hard disk drives or solid-state drives (internal or external, e.g., having Universal Serial Bus (USB) and/or Firewire interfaces), e.g. those available from Seagate (e.g., the Seagate Barracuda 7102 family) or Hitachi (e.g., the Hitachi Deskstar 7K1000), one or more optical discs, Redundant Array of Independent Disks (RAID) storage, e.g. an array of disks (e.g., SATA arrays), available from various vendors including Dot Hill Systems Corp., LaCie, Nexsan Technologies, Inc. and Enhance Technology, Inc.

Bus 420 communicatively couples processor(s) 470 with the other memory, storage, and communication blocks. Bus 420 can be, e.g., a Peripheral Component Interconnect (PCI)/PCI Extended (PCI-X) bus, Small Computer System Interface (SCSI), USB or the like, for connecting expansion cards, drives and other subsystems as well as other buses, such a front side bus (FSB), which connects processor 470 to software system.

Optionally, operator and administrative interfaces, e.g., a display, keyboard, and a cursor control device, may also be coupled to bus 420 to support direct operator interaction with controller 120. Other operator and administrative interfaces can be provided through network connections connected through communication port 460. The external storage device 410 can be any kind of external hard-drives, floppy drives, IOMEGA® Zip Drives, Compact Disc-Read Only Memory (CD-ROM), Compact Disc-Re-Writable (CD-RW), Digital Video Disk-Read Only Memory (DVD-ROM). Components described above are meant only to exemplify various possibilities. In no way should the aforementioned exemplary controller 120 limit the scope of the subject disclosure.

While the subject disclosure has been described with reference to exemplary embodiments, it will be understood by those skilled in the art that various changes may be made and equivalents may be substituted for elements thereof without departing from the scope of the subject disclosure as defined by the appended claims. Modifications may be made to adopt a particular situation or material to the teachings of the subject disclosure without departing from the scope thereof. Therefore, it is intended that the subject disclosure not be limited to the particular embodiment disclosed, but that the subject disclosure includes all embodiments falling within the scope of the subject disclosure as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A system for detecting low indoor air quality (IAQ) and enabling ventilation in zones of a multi-zone environment, the system comprising:

one or more zone dampers configured in one or more supply air channels associated with one or more zones of an area of interest (AOI), such that one of the zone dampers is configured in each of the supply channels for individually regulating the flow of supply air into each of the zones;

an IAQ sensor configured in a common return duct associated with the AOI, wherein the IAQ sensor is operable to monitor IAQ values of a combined return air received collectively from the one or more zones; and a controller in communication with the one or more zone dampers and the IAQ sensor, wherein when the IAQ values of the combined return air are detected to vary and/or go below predetermined values, the controller is configured to:

successively operate one of the zone dampers in an open state while operating the remaining zone dampers among the one or more zone dampers in a closed state, such that the supply air flows into the zone having the respective zone damper in the open state and the corresponding return air from the respective zone flows into the common air duct;

successively monitor, using the IAQ sensor, the IAQ values of the return air received from each of the zones when the respective zone damper is in the open state; and detect a low IAQ condition in the respective zones being monitored when difference is detected between the IAQ values of the return air from the respective zone, and the IAQ values of the combined return air received collectively from the one or more zones.

2. The system of claim 1, wherein the system comprises one or more return air channels fluidically configured between the one or more zones and the common air duct, such that one of the return air channels is fluidically configured between one of the zones and the common air duct for individually supplying/regulating the return air from each of the zones into the combined air duct as the combined return air.

3. The system of claim 1, wherein the system comprises an air ventilator configured in at least one of the one or more zones, wherein the controller is configured to actuate the ventilator of the zone having the low IAQ condition to ventilate the low IAQ value air from the respective zone.

4. The system of claim 1, wherein the system comprises at least one blower fan configured with the one or more supply air channels, wherein the controller is configured to actuate the at least one blower fan to facilitate flow of the supply air from the one or more supply air channels to the common air duct via the one or more zones and the respective one or more return air channels.

5. The system of claim 1, wherein the system comprises an air handling unit (AHU) associated with the AOI, the AHU is fluidically connected to the one or more supply air channels and is in communication with the controller, wherein the controller is configured to actuate the AHU to facilitate flow of the supply air from the one or more supply air channels to the common air duct via the one or more zones and the respective one or more return air channels.

6. The system of claim 1, wherein the controller is configured to actuate the at least one blower fan or the AHU to enable the flow of ambient air into the zone having the low IAQ condition to facilitate ventilation of the low IAQ value air from the respective zone.

7. The system of claim 1, wherein the controller is configured to generate and transmit an alert signal to one or more mobile devices associated with one or more occupants of the one or more zones having the low IAQ condition.

8. The system of claim 1, wherein the system comprises a thermostat configured in each of the zones, wherein the controller is in communication with the thermostat and configured to generate and transmit an alert signal to the thermostat associated with the zone having the low IAQ condition.

9. The system of claim 8, wherein the alert signal is indicative of the detection of low IAQ values at the respective zone and a request to the corresponding occupant to manually ventilate the respective zone by opening doors and windows of the zone.

10. The system of claim 1, wherein when the IAQ values of the combined return air are detected to be constant or above the predetermined values, the controller is configured to operate the one or more zone dampers in any of the open state, a semi-closed state, the closed state based on predefined IAQ values set by the one or more occupants using the thermostat.

11. The system of claim 1, wherein the AOI is a building and the one or more zones are the one or more rooms of the building.

12. A method for detecting low indoor air quality (IAQ) and enabling ventilation in zones of a multi-zone environment, the method comprising the steps of:

monitoring, by an IAQ sensor configured in a common return duct associated with an AOI, a combined return air received collectively from one or more zones associated with the AOI, wherein one or more zone dampers are configured in one or more supply channels associated with each of the zones for individually regulating the flow of supply air into each of the zones and the common air duct is fluidically connected to each of the zones via one or more return air channels;

successively operating, by a controller, when the IAQ values of the combined return air are detected to vary and/or go below predetermined values, one of the zone dampers in an open state while operating the remaining zone dampers among the one or more zone dampers in a closed state, such that the supply air flows into the zone having the respective zone damper in the open state and the corresponding return air from the respective zone flows into the common air duct;

successively monitoring, by the controller, using the IAQ sensor, the IAQ values of the return air received from each of the zones when the respective zone damper is in the open state; and detecting, by the controller, a low IAQ condition in the respective zones being monitored when a difference is detected between the IAQ values of the return air from the respective zone, and the IAQ values of the combined return air received collectively from the one or more zones.

13. The method of claim 12, wherein the method comprises the steps of actuating, by the controller, a ventilator associated with the zone having the low IAQ condition to ventilate the low IAQ value air from the respective zone.

14. The method of claim 12, wherein the method comprises the step of actuating, at least one blower fan configured with the one or more supply air channels, to facilitate flow of the supply air from the one or more supply air channels to the common air duct via the one or more zones and the respective one or more return air channels.

15. The method of claim 12, wherein the method comprises the step of actuating an air handling unit (AHU) associated with the AOI to facilitate flow of the supply air from the one or more supply air channels to the common air duct via the one or more zones and the respective one or more return air channels.

16. The method of claim 12, wherein the method comprises the step of actuating, by the controller, the at least one blower fan or the AHU to enable the flow of ambient air into the zone having the low IAQ condition to facilitate ventilation of the low IAQ value air from the respective zone.

17. The method of claim 12, wherein the method comprises the step of generating and transmitting, by the controller, an alert signal to one or more mobile devices associated with one or more occupants of the one or more zones having the low IAQ condition.

18. The method of claim 12, wherein the method comprises the step of generating and transmitting, by the controller, an alert signal to the thermostat associated with the zone having the low IAQ condition.

19. The method of claim 18, wherein the alert signal is indicative of the detection of low IAQ values at the respective zone and a request to the corresponding occupant to manually ventilate the respective zone by opening doors and windows of the zone.

20. The method of claim 12, wherein when the IAQ values of the combined return air are detected to be constant and/or above the predetermined values, the method comprises the steps of operating, by the controller, the one or more zone dampers in the open state, a semi-closed state, or the closed state, based on predefined IAQ values set by the one or more occupants using the thermostat.

* * * * *